US005357172A

United States Patent [19]

Lee et al.

[11] Patent Number: 5,357,172

[45] Date of Patent: Oct. 18, 1994

[54] CURRENT-REGULATED FIELD EMISSION CATHODES FOR USE IN A FLAT PANEL DISPLAY IN WHICH LOW-VOLTAGE ROW AND COLUMN ADDRESS SIGNALS CONTROL A MUCH HIGHER PIXEL ACTIVATION VOLTAGE

[75] Inventors: John K. Lee; Stephen L. Casper; Tyler A. Lowrey, all of Boise, Id.

[73] Assignee: Micron Technology, Inc., Boise, Id.

[21] Appl. No.: 11,927

[22] Filed: Feb. 1, 1993

Related U.S. Application Data

[63] Continuation-in-part of Ser. No. 864,702, Apr. 7, 1992, Pat. No. 5,210,472.

[51] Int. Cl.[5] ..... H05B 41/36; H01J 17/36

[52] U.S. Cl. ..... 315/167; 315/334; 315/339; 315/349; 315/DIG. 7

[58] Field of Search ..... 315/169.1, 169.3, 169.4, 315/320, 325, 334, 349, 337, 339, 167, DIG. 7

[56] References Cited

U.S. PATENT DOCUMENTS

| | | | |
|---|---|---|---|
| 3,329,949 | 7/1967 | Colton et al. | 315/334 |
| 3,611,022 | 10/1971 | Galusha | 315/320 |
| 4,940,916 | 7/1990 | Borel et al. | 313/306 |
| 5,162,704 | 11/1992 | Kobori et al. | 315/349 |

*Primary Examiner*—David Mis

*Attorney, Agent, or Firm*—Angus C. Fox, III

[57] ABSTRACT

In a flat panel display in which low-voltage row and column address signals control a much higher pixel activation voltage by respectively gating at least one pair of series coupled MOSFETs to ground for each pixel, effective current regulation is achieved by placing a current-regulating resistor in series with each pair of the series-coupled MOSFETs. The resistor is coupled directly to ground and to the source of the MOSFET furthest from the emitter node. By coupling the current-regulating resistor directly to the ground bus, stable current values are achieved over a wide range of cathode voltages.

5 Claims, 3 Drawing Sheets

CURRENT-REGULATED FIELD EMISSION CATHODES FOR USE IN A FLAT PANEL DISPLAY IN WHICH LOW-VOLTAGE ROW AND COLUMN ADDRESS SIGNALS CONTROL A MUCH HIGHER PIXEL ACTIVATION VOLTAGE

This application is a continuation-in-part of application Ser. No. 07/864,702 that was filed on Apr. 7, 1992 and is now issued as U.S. Pat. No. 5,210,272. U.S. Pat. No. 5,210,472 is incorporated herein by reference, as though set forth in its entirety.

FIELD OF THE INVENTION

This invention relates to flat panel displays and, more particularly, to effective current regulation in a matrix-addressable flat panel display in which low-voltage row and column address signals control a much higher pixel activation voltage. This invention not only permits the use of row and column signal voltages that are compatible with standard integrated circuit logic levels, but also provides regulated, low-current operation that extends cathode life expectancy and reduces power consumption requirements.

BACKGROUND OF THE INVENTION

For more than half a century, the cathode ray tube (CRT) has been the principal device for displaying visual information. Although CRTs have been endowed during that period with remarkable display characteristics in the areas of color, brightness, contrast and resolution, they have remained relatively bulky and power hungry. The advent of portable computers has created intense demand for displays which are lightweight, compact, and power efficient. Although liquid crystal displays are now used almost universally for laptop computers, contrast is poor in comparison to CRTs, only a limited range of viewing angles is possible, and in color versions, they consume power at rates Which are incompatible with extended battery operation. In addition, color screens tend to be far more costly than CRTs of equal screen size.

As a result of the drawbacks of liquid crystal display technology, thin film field emission display technology has been receiving increasing attention by industry. Flat panel display utilizing such technology employ a matrix-addressable array of pointed, thin-film, cold field emission cathodes in combination with a phosphor-luminescent screen. Somewhat analogous to a cathode ray tube, individual field emission structures are sometimes referred to as vacuum microelectronic triodes. The triode elements are a cathode (emitter tip), a grid (also referred to as the gate), and an anode (typically, the phosphor-coated element to which emitted electrons are directed).

Although the phenomenon of field emission was discovered in the 1950's, extensive research by many individuals, such as Charles A. Spindt of SRI International, has improved the technology to the extent that its prospects for use in the manufacture of inexpensive, low-power, high-resolution, highcontrast, full-color flat displays appear promising. However, much work remains to be done in order to successfully commercialize the technology.

There are a number of problems associated with contemporary matrix-addressable field-emission display designs. To date, such displays have been constructed such that a column signal activates a single conductive strip within the grid, while a row signal activates a conductive strip within the emitter base electrode. At the intersection of an activated column and an activated row, a grid-to-emitter voltage differential sufficient to induce field emission will exist, causing illumination of an associated phosphor on the phosphorescent screen. In FIG. 1, which is representative of such contemporary architecture, three grid (grid) strips 11A, 11B, and 11C orthogonally intersect a trio of emitter base electrode (row) strips 12A, 12B, and 12C. In this representation, each row-column intersection (the equivalent of a single pixel within the display) contains 16 field emission cathodes (also referred to herein as "emitters") 13. In reality, the number of emitter tips per pixel may vary greatly. The tip of each emitter tip is surrounded by a grid strip aperture 14. In order for field emission to occur, the voltage differential between a row conductor and a column conductor must be at least equal to a voltage which will provide acceptable field emission levels. Field emission intensity is highly dependent on several factors, the most important of which is the sharpness of the cathode emitter tip and the intensity of the electric field at the tip. Although a level of field emission suitable for the operation of flat panel displays has been achieved with emitter-to-grid voltages as low as 80 volts (and this figure is expected to decrease in the coming years due to improvements in emitter structure design and fabrication) emission voltages will probably remain far greater than 5 volts, which is the standard CMOS, NMOS, and TTL "1" level. Thus, if the field emission threshold voltage is at 80 volts, row and column lines will, most probably, be designed to switch between 0 and either + 40 or − 40 volts in order to provide an intersection voltage differential of 80 volts. Hence, it will be necessary to perform high-voltage switching as these row and column lines are activated. Not only is there a problem of building drivers to switch such high voltages, but there is also the problem of unnecessary power consumption because of the capacitive coupling of row and column lines. That is to say, the higher the voltage on these lines, the greater the power required to drive the display.

In addition to the problem of high-voltage switching, aperture displays suffer from low yield and low reliability due to the possibility of emitter-to-grid shorts. Such a short affects the voltage differential between the emitters and grid within the entire array, and may well render the entire array useless, either by consuming so much power that the supply is not able to maintain a voltage differential sufficient to induce field emission, or by actually generating so much heat that a portion of the array is actually destroyed.

A new field emission display architecture, which is the subject of U.S. Pat. No. 5,210,472 overcomes the problems of high-voltage switching and emitter-to-grid shorts, which, in turn, ameliorates the problem of display power consumption. The new architecture (hereinafter referred to as the "low-voltage-switching field emission display architecture") permits the switching of a high pixel activation voltage with low signal voltages that are compatible with standard CMOS, NMOS, or other integrated circuit logic levels. Instead of having row and columns tied directly to the cathode array, they are used to gate at least one pair of series-connected field effect transistors (FETs), each pair when conductive coupling the base electrode of a single emitter node to a potential that is sufficiently low, with respect to a higher potential applied to the grid, to induce field emission. Each row-column intersection (i.e. pixel) within the display may contain multiple emitter nodes in order to improve manufacturing yield and product reliability. In a preferred embodiment, the grid of the array is held at a constant potential ($V_{FE}$), which is consistent with reliable field emission when the emitters are at ground potential. A multiplicity of emitter nodes are employed, one or more of which correspond to a single pixel (i.e., row and column intersection). Each emitter node has its own base electrode, which is groundable through its own pair of series-coupled field-effect transistors by applying a signal voltage to both the row and column lines associated with that emitter node. One of the series-connected FETs is gated by a signal on the row line; the other FET is gated by a signal on the column line. Also in the preferred embodiment of the invention, each emitter node contains multiple cathode emitters. Hence, each row-column intersection controls multiple pairs of series coupled FETs, and each pair controls a single emitter node (pixel) containing multiple emitters.

The regulation of cathode-to-grid current has become a major issue in the design of field emission displays, as the issues of cathode life expectancy, low power consumption, and stability requirements are addressed.

The issue of current regulation has been addressed with respect to conventionally constructed flat panel field emission displays, such as the one depicted in FIG. 1. For example, in U.S. Pat. No. 4,940,916, Michel Borel and three colleagues disclose a field emission display having a resistive layer between each cathode (emitter tip) and an underlying conductive layer. In a subsequent U.S. Pat. No. 5,162,704, Yoichi Bobori and Mitsuru Tanaka disclose a field emission display having a diode in series with each emitter tip.

The present invention is directed at reducing power consumption and enhancing reliability and stability in the low-voltage switching field emission display architecture by regulating cathode emission current.

SUMMARY OF THE INVENTION

Effective current regulation for the low-voltage switching field emission display architecture is achieved by placing a resistor in series with each pair of series-coupled low-voltage switching MOSFETs. As heretofore explained, each MOSFET pair couples an emitter node, which contains one or more field emitter tips, to ground. The resistor is coupled directly to the ground bus and to the source of the MOSFET furthest from the emitter node. By coupling the current regulating resistor directly to the ground bus, stable current values independent of cathode voltage are achieved over a wide range of cathode voltages.

PREFERRED EMBODIMENT OF THE INVENTION

Figure 1:
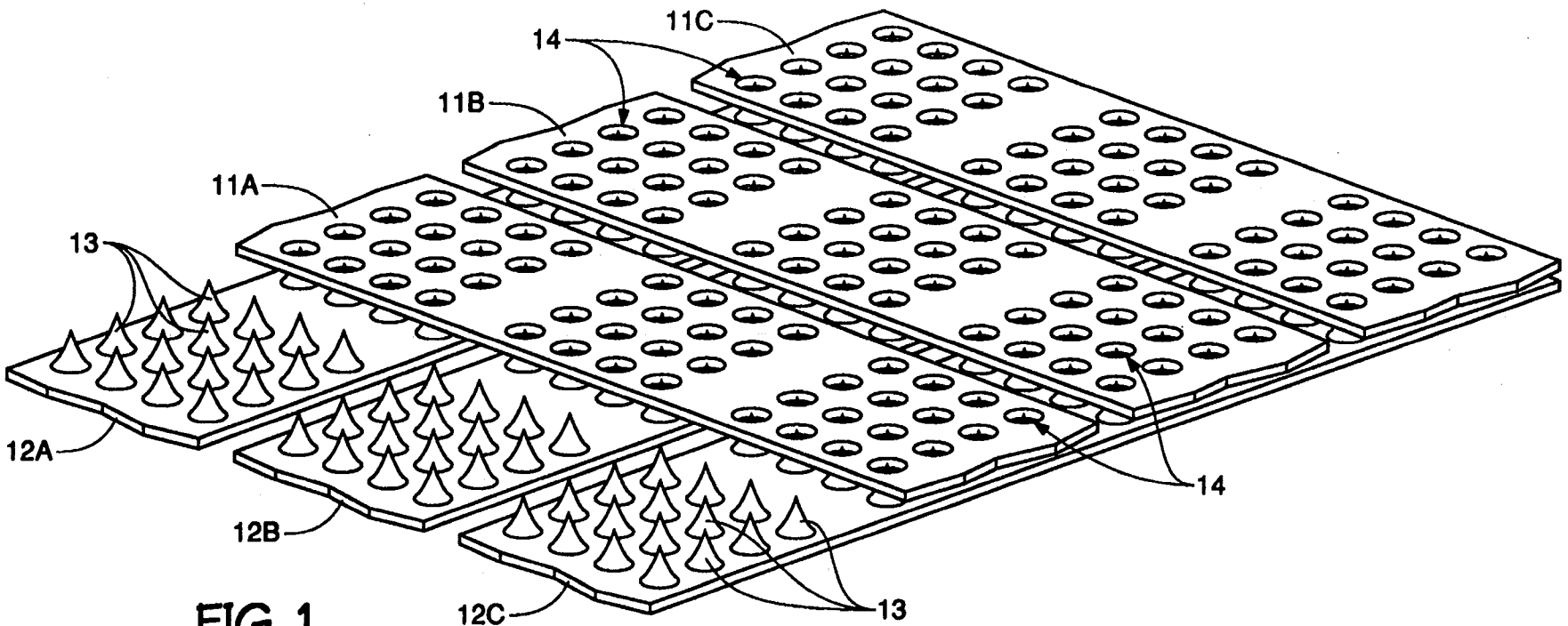
FIG. 1 (PRIOR ART)
FIG. 1 is a simplified perspective view of the grid and emitter base electrode structure in a contemporary conventional flat-panel field-emission display.
Figure 2:
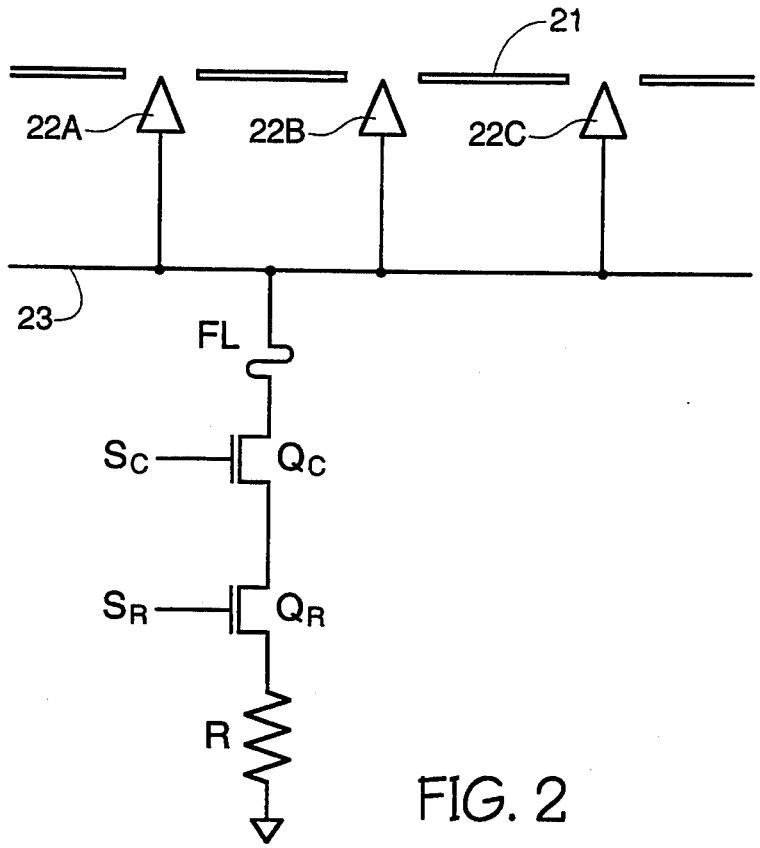
FIG. 2 is a schematic diagram of a first embodiment of a single emitter node within the low-voltage switching field emission display architecture that incorporates a current regulating resistor.

Referring now to FIG. 2, a single first embodiment emitter node within the low-voltage switching field-emission display architecture is characterized by a conductive grid (also referred to as a first pixel element) 21, which is continuous throughout the entire array, and which is maintained at a constant potential, $V_{GRID}$. Each pixel element within the array is illuminated by an emitter group. In order to enhance product reliability and manufacturing yield, each emitter group comprises multiple emitter nodes, and each node contains multiple field emission cathodes (also referred to as "field emitters" or "emitters"). Although the single emitter node depicted by FIG. 2 has only three emitters (22A, 22B, and 22C), the actual number may be much higher. Each of the emitters 22 is connected to a base electrode 23 that is common to only the emitters of a single emitter node. The combination of emitters and base electrode is also referred to herein as a second pixel element.

For the architectural embodiment depicted in FIG. 2, the base electrode 23 is insulated from the grid 21. In order to induce field emission, base electrode 23 is grounded through a pair of series-coupled field-effect transistors $Q_C$ and $Q_R$ and current-regulating resistor R. Resistor R is interposed between the source of transistor $Q_R$ and ground. Transistor $Q_C$ is gated by a column line signal $S_C$, while transistor $Q_R$ is gated by a row line signal $S_R$. Standard logic signal voltages for CMOS, NMOS, TTL and other integrated circuits are generally 5 volts or less, and may be used for both column and row line signals. It should be noted that other control-logic-gated FETs may be optionally added in series within each grounding path. A pixel is turned off (i.e., placed in a non-emitting state) by turning off either or both of the series-connected FETs ($Q_C$ and $Q_R$). From the moment that at least one of the FETs becomes non-conductive (i.e., the gate voltage $V_{GS}$ drops below the device threshold voltage $V_T$), electrons will continue to be discharged from the emitter tips corresponding to that pixel until the voltage differential between the base and the grid is just below emission threshold voltage.

In the likely case where grid voltage is greater than 20 volts, the MOSFET nearest the grid 21 (in this case MOSFET $Q_C$) must be a high-voltage device in order to prevent cathode-tosubstrate breakdown. The breakdown requirements of such a high-voltage transistor will depend on the voltage swing of the emitter node.

Still referring to FIG. 2, a fusible link FL is placed in series with the pull-down current path from base electrode 23 to ground via transistors $Q_C$ and $Q_R$. Fusible link FL may be blown during testing if a base-to-emitter short exists within that emitter group, thus isolating the shorted group from the rest of the array in order to improve yield and to minimize array power consumption. It should be noted that the position of fusible link FL within the current path is inconsequential, from a circuit standpoint. That is, it accomplishes the purpose of isolating a shorted node whether it is located between transistors $Q_C$ and $Q_R$, between the base electrode 23 and the grounding transistor pair, as actually shown in FIG. 2, or between ground and the grounding transistor pair.

With further reference to FIG. 2, gray scaling (i.e., variations in pixel illumination) in an operational display may be accomplished by varying the duty cycle (i.e. the period that the emitters within a pixel are actually emitting as a percentage of frame time). Brightness control can be accomplished by varying the emitter current by varying the gate voltages of either transistor $Q_C$ or $Q_R$ or both.

Figure 3:
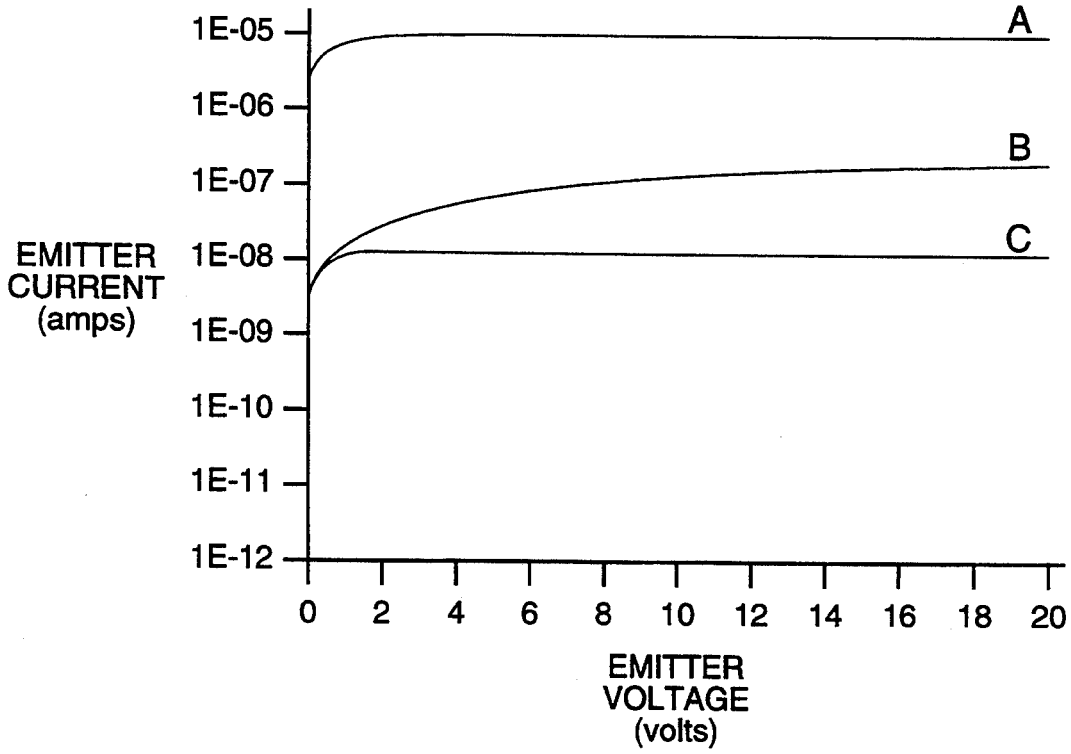
FIG. 3 is a graph of emitter current as a function of cathode voltage for the low-voltage switching architecture with no current regulating resistor (plot A); with a current regulating resistor interposed between the cathode tip (or tips) and the two series-coupled low-voltage switching MOSFETS (plot B); and with a current regulating resistor interposed between the ground bus and the two Series-coupled MOSFETs (plot C)

Referring now to the graph of FIG. 3, cathode current is plotted as a function of cathode potential for three representative cases of current regulation in the low-voltage switching field emission display architecture. In all three cases, the cathode (emitter tip) is grounded through the channels of a pair of low-voltage-switching transistors (MOSFETs). Plot A depicts the case where there is no current regulating resistor in the path to ground. Plot B depicts the case where a resistor is interposed between the cathode and the two series-coupled MOSFETs. Plot Cidepicts the case where the resistor is interposed between ground and the two series coupled MOSFETs. For this example, we Will assume that, as in FIG. 2, $Q_C$, the MOSFET gated by the column signal is nearer (electrically, not necessarily physically) the cathode, while $Q_R$, the MOSFET gated by the row signal is nearest to ground. The gate voltages (i.e., the column and row signals) for both $Q_C$ and $Q_R$ are equal, at 5.0 volts. When a resistor R is utilized (cases B and C), its value is determined on the basis of the specific current limiting requirements. In case A, relatively constant cathode-to-grid current is achieved at a level of approximately 10 Vamps over a cathode potential range of 2 to 20 volts. In this case, current is regulated only by the saturation characteristics of the series-coupled transistors. In case B, a reduction in cathode-to-grid current is achieved over the same range, but the current is proportional to cathode voltage. In case C, relatively constant cathode-to-grid current is achieved at a level of approximately 10 nanoamps over the same range. The value of the current-regulating resistor may be adjusted to provide optimum current values. The advantages of case C are easily explained. If current is to be constant over a range of cathode-to-grid potentials, the voltage drop across the current-regulating resistor must be constant. This is true of case C. Since the potential at the source of MOSFET $Q_C$ and the drain of MOSFET $Q_R$ (the node between MOSFET $Q_C$ and MOSFET $Q_R$) remains relatively constant as long as the gate voltage on MOSFET $Q_C$ is less than or equal to the cathode voltage (being equal to the gate voltage on MOSFET $Q_C$ minus a $V_t$ drop voltage drop), the voltage at the source of MOSFET $Q_R$ (being equal to the gate voltage on MOSFET $Q_R$ minus a $V_t$ drop) will also remain constant. Thus, where the current-regulating resistor R is interposed between the source of MOSFET $Q_R$ and ground, the voltage drop across resistor R will be constant, as will the current flow through resistor R. It should be noted that placement of the current-limiting resistor R between the source of MOSFET $Q_C$ and the drain of MOSFET $Q_R$ is not feasible, due to the high voltage drop across the resistor, and the resultant low voltage at the drain of MOSFET $Q_R$. With negligible voltage at its drain, MOSFET $Q_R$ becomes difficult to turn "on".

Figure 4:
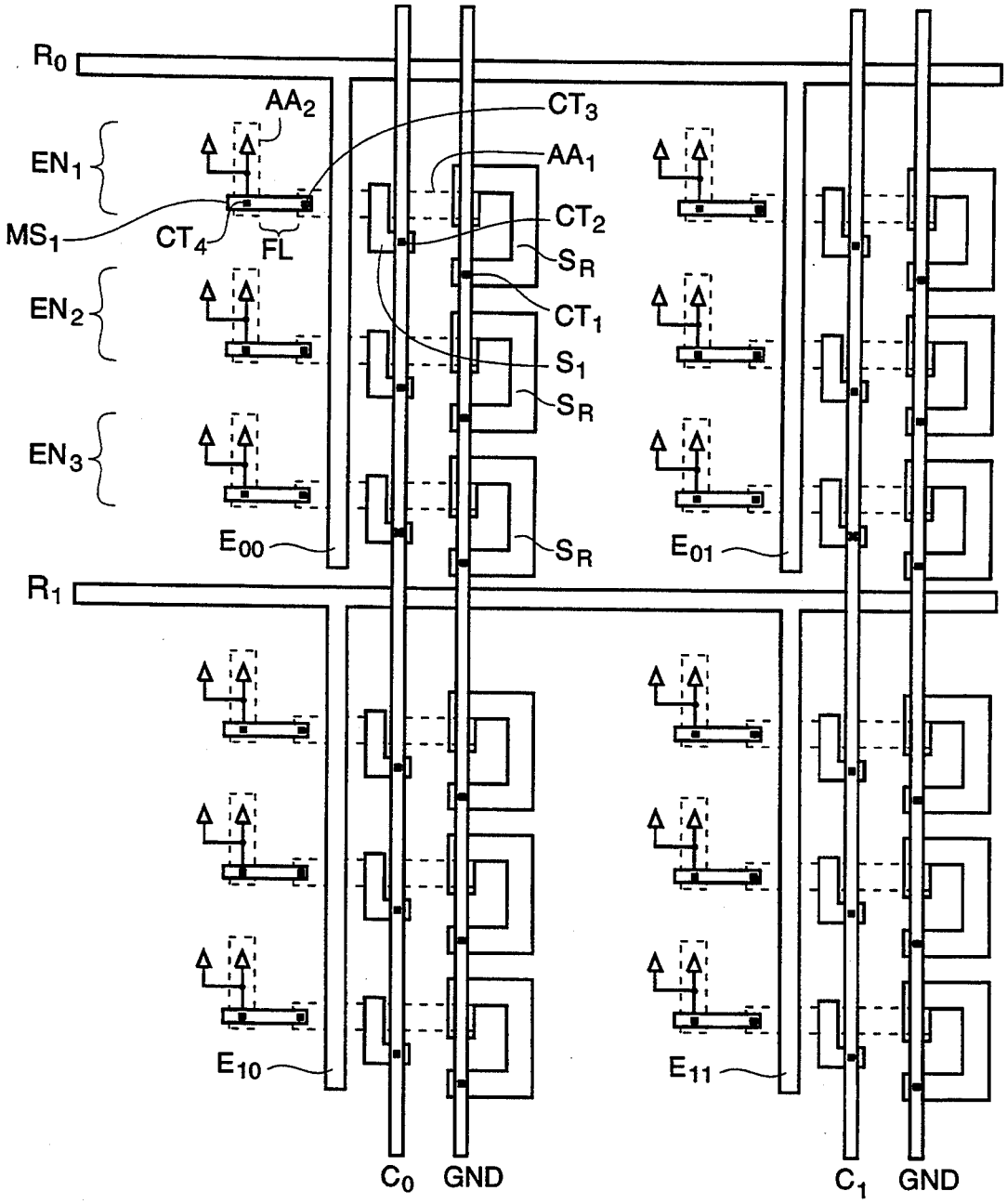
FIG. 4 is a top plan view of a preferred embodiment layout of the low-voltage switching field emission display architecture that incorporates a current-regulating resistor.

Referring now to FIG. 4, a simplified layout is depicted, which provides for multiple emitter nodes for each row-column intersection of the display array. A pair of polysilicon row lines $R_0$ and $R_1$ orthogonally intersect metal column lines $C_0$ and $C_1$, as well as a pair of metal ground lines $GND_0$ and $GND_1$. Ground line $GND_0$ is associated with column line $C_0$, while ground line $GND_1$ is associated with column line $C_1$. For each row and column intersection (i.e., an individually addressable pixel within the display), there is at least one rowline extension, which forms the gates and gate interconnects for multiple emitter nodes within that pixel.

For example, extension $E_{00}$ is associated with the intersection of row $R_0$ and column $C_0$; extension $E_{01}$ is associated with the intersection of row $R_0$ and column $C_1$; extension $E_{10}$ is associated with the intersection of row $R_1$ and column $C_0$; and extension $E_{11}$ is associated with the intersection of row $R_1$ and column $C_1$. As all intersections function in an identical manner, only the components with the $R_0$-$C_0$ intersection region will be described in detail.

Still referring to FIG. 4, the $R_0$-$C_0$ intersection region supports three identical emitter nodes, $EN_1$, $EN_2$, and $EN_3$. Each emitter node comprises a first active area $AA_1$ and a second active area $AA_2$. In this exemplary layout, the current regulating resistor R is formed from a C-shaped polysilicon strip $S_R$. One end of C-shaped polysilicon strip $S_R$ makes direct contact to first active area $AA_1$, and the other end makes contact to a metal ground line, or bus, GND at first contact $CT_1$. Although most of the C-shaped polysilicon strip is lightly doped at a level which appropriately adjusts the resistance value of resistor R, the ends thereof are heavily doped so that effective ohmic contact may be made. In combination with first active area $AA_1$, an L-shaped polysilicon strip S1 forms the gate of field-effect transistor $Q_C$ (refer to the schematic of FIG. 2). Metal column line $C_0$ makes contact to polysilicon strip $S_1$ at second contact $CT_2$. Polysilicon extension $E_{00}$ forms the gate of field-effect transistor $Q_R$ (refer once again to FIG. 2). A first metal strip $MS_1$ interconnects first active area $AA_1$ and second active area $AA_2$, making contact at third contact $CT_3$ and fourth contact $CT_4$, respectively. The portion of metal strip $MS_1$ between third contact $CT_3$ and fourth contact $CT_4$ forms fusible link FL. Second active area $AA_2$ functions as the base electrode, having emitter tips $T_1$, $T_2$ and $T_3$ constructed thereon. It must be emphasized that the layout of FIG. 4 is meant to be only exemplary. Other equivalent layouts are possible, and other resistive and conductive materials may be substituted for the polysilicon and metal structures.

Although only several embodiments of the invention have been disclosed in detail herein, it will be obvious to those having ordinary skill in the art that changes and modifications may be made thereto without departing from the scope and spirit of the invention as claimed. While the particular embodiment as herein depicted and described is fully capable of attaining the objectives and providing the advantages hereinbefore stated, it is to be understood that this disclosure is meant to be merely illustrative of the presently-preferred embodiment of the invention, and that no limitations are intended with regard to the details of Construction or design thereof beyond the limitations imposed by the appended claims.

We claim:

1. A current-regulated field emission display comprising:

multiple row address lines;

multiple column address lines;

said row address lines intersecting said column address lines, with the intersection of a single row address line with a single column address line being associated with a single pixel within said display;

a grid which is common to the entire display, and which is held at a first potential;

groups of field emission cathodes, each group being associated with a particular pixel, each group being maintained at a second potential during periods of pixel inactivation, said second potential being close enough to said first potential so as to suppress field emission, and each group being maintained at a third potential during periods of pixel activation, said third potential being sufficiently low, with respect to said first potential, to induce field emission;

at least one pull-down current path between the cathode group of each pixel and a node held at a fourth potential that is less than or equal to said third potential, said path comprising a current-regulating resistor and at least two field-effect transistors, said resistor and said transistors being series coupled, with said resistor being directly coupled to said node, at least one of said transistors being activatable in response to a signal on pixel's respective row address line, at least one other transistor being activatable in response to a signal on a that pixel's respective column address line, so as to enable switching of the potential applied to the cathode group associated with that pixel between said second potential and said third potential.

2. The current-regulated field emission display of claim 1, wherein said node is maintained at ground potential.

3. The current-regulated field emission display of claim 1, wherein each cathode group associated with a particular pixel is comprised of multiple cathode subgroups, each subgroup having its own pull-down current path.

4. A current-regulated, vacuum micro-electronic triode comprising:

a grid which is continuously maintained at a first potential;

a field emission cathode to which a second potential or a third potential may be selectively applied, said second potential being close enough to said first potential so as to suppress field emission, said third potential being sufficiently low, with respect to said first potential, to induce field emission;

a pull-down current path between the cathode and a node held at a fourth potential that is less than or equal to said third potential, said path comprising a current-regulating resistor and at least one field-effect transistor, said resistor and said transistor being series coupled, with said resistor being directly coupled to said node, said transistor being selectively activatable so as to enable selective application of said second potential or said third potential to said cathode.

5. The current-regulated vacuum micro-electronic triode of claim 4, wherein said pull-down current path comprises a current-regulating resistor and two field-effect transistors, one of said transistors being activatable in response to a row address signal, and the other of said transistors being activatable in response to a column address signal.

* * * * *